United States Patent [19]

Miyauchi et al.

[11] Patent Number: 4,675,098

[45] **Date of Patent: * Jun. 23, 1987**

[54] PROCESS FOR THERMAL CRACKING OF HEAVY OIL

[75] Inventors: Terukatsu Miyauchi, Yokohama; Yoneichi Ikeda, Kamakura; Tatsuji Kikuchi, Tokyo, all of Japan

[73] Assignee: Fuji Standard Research Kabushiki Kaisha, Tokyo, Japan

[ * ] Notice: The portion of the term of this patent subsequent to Dec. 25, 2001 has been disclaimed.

[21] Appl. No.: 622,490

[22] Filed: Jun. 20, 1984

[30] Foreign Application Priority Data

May 22, 1984 [JP] Japan ..... 59-103161

[51] Int. Cl.[4] ..... C10G 9/32

[52] U.S. Cl. ..... 208/127; 208/106

[58] Field of Search ..... 208/251 R, 127, 91, 208/159, 106

[56] References Cited

U.S. PATENT DOCUMENTS

| | | | |
|---|---|---|---|
| 2,462,891 | 3/1949 | Noll | 208/91 X |
| 2,506,317 | 5/1950 | Rex | 208/159 |
| 2,755,782 | 7/1956 | Campbell et al. | 208/159 X |
| 3,527,694 | 9/1970 | Lickenbach | 208/118 |
| 4,088,567 | 5/1978 | White | 208/251 R X |
| 4,213,848 | 7/1980 | Saxton | 208/127 |
| 4,243,514 | 1/1981 | Bartholic | 208/91 |
| 4,263,128 | 4/1981 | Bartholic | 208/127 X |
| 4,305,809 | 12/1984 | Chen et al. | 208/127 |
| 4,309,274 | 1/1982 | Bartholic | 208/127 X |
| 4,318,800 | 3/1982 | Woebcke et al. | 208/127 X |
| 4,427,538 | 1/1984 | Bartholic | 208/127 |

*Primary Examiner*—Glenn Caldarola

*Attorney, Agent, or Firm*—Oblon, Fisher, Spivak, McClelland & Maier

[57] ABSTRACT

An improved process for thermal cracking of a heavy oil comprising a step of thermal cracking of the heavy oil in contact with a fluidized bed of heated fine particles and a step of gasification of the coke which has deposited on the fine particles used in the thermal cracking, which gasification is conducted on the fine particles withdrawn from the thermal cracking step by contacting the particles with gas containing molecular oxygen while the particles are fluidized by the gas, the steps being practiced while the fine particles are circulated therebetween is disclosed. The improvement comprises a use of fine particles of a porous material, and conducting the gasification under specified conditions and so as to produce a product gas which is highly reducing. Production of reducing gas at the gasification step whereby the used fine particles are regenerated for further use in the thermal cracking step results in converting by reduction heavy metals which have come from the heavy oil as the feed stock and are accumulated on the fine particles used into a state less harmful for the thermal cracking where the regenerated fine particles are used.

11 Claims, 1 Drawing Figure

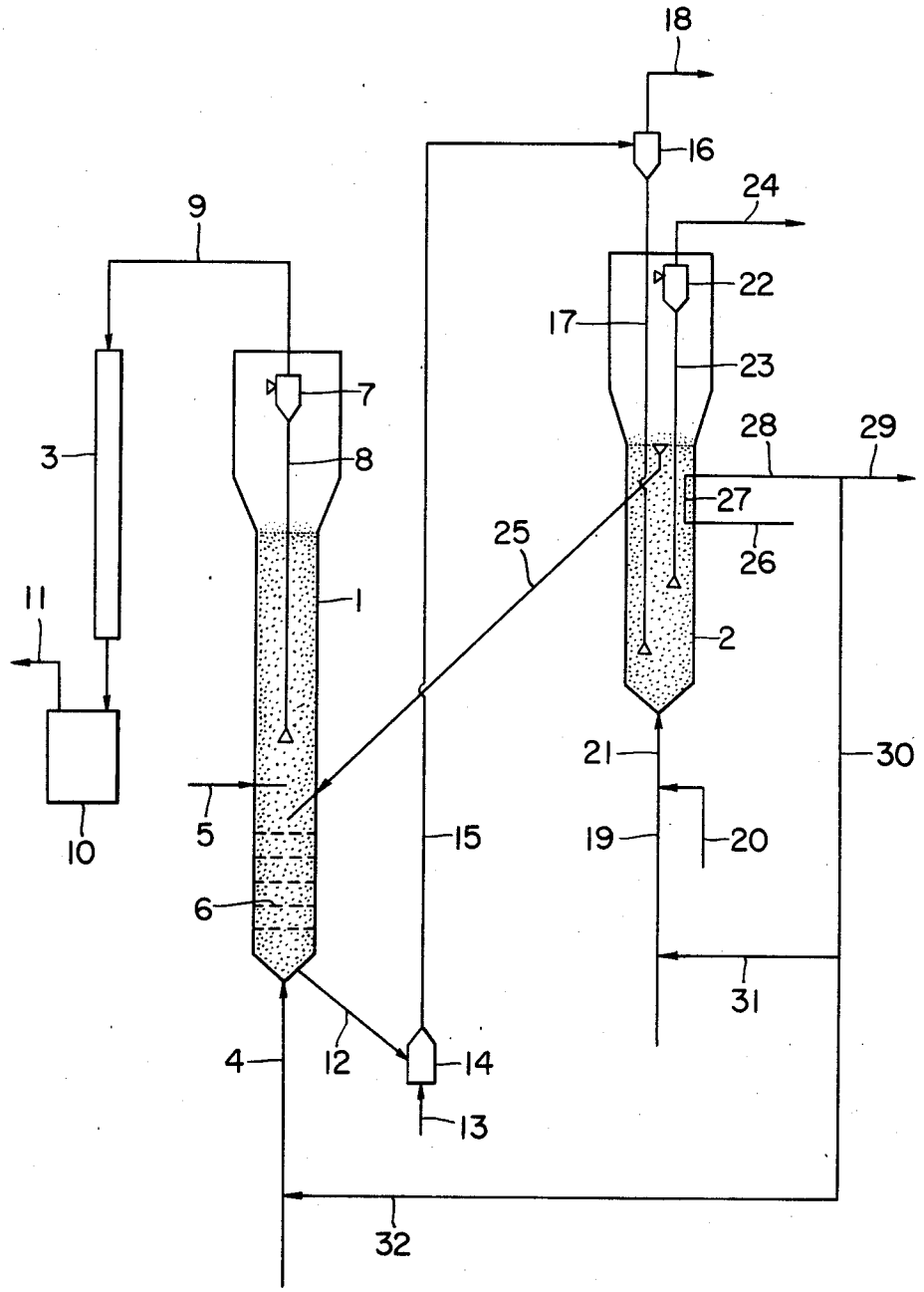
18
16
24
9
22
17
23
7
3
8
28
29
27
25
26
11
1
2
21
30
5
15
19
20
10
6
31
4
12
14
13
32

PROCESS FOR THERMAL CRACKING OF HEAVY OIL

BACKGROUND OF THE INVENTION

This invention relates to a process for thermal cracking of a heavy hydrocarbon oil (hereinafter abbreviated as heavy oil) to obtain primarily light hydrocarbons (hereinafter abbreviated as light oils) which are liquid at room temperature. More particularly, the present invention relates to an improvement of a process, which comprises carrying out a step of thermal cracking in which a heavy oil is contacted with fine particles of a porous material fluidized with a steam-containing gas and the step of gasification in which the coke deposited on the fine particles from the thermal cracking step is removed while the fine particles are fluidized with a molecular oxygen-containing gas or a steam-containing gas, while the fine particles are circulated between both of these steps.

Some of the present inventors have previously discovered that, in thermal cracking of a heavy oil in contact with a fluidized-bed of heated particles can be practiced under good fluidized state of the bed and with good efficiency when use is made of fine particles comprising particles having a weight average diameter of 0.04 to 0.12 mm and 5 to 50 wt. % of particles with a diameter of 0.044 mm or less, and named this process as Fluid Thermal Cracking (Japanese Laid-open Patent Publication No. 10587/1981).

They have also disclosed that when use is made of fine particles which have a pore volume of 0.1 to 1.5 $m^3/g$, a specific surface area of 50 to 1500 $m^2/g$ and a weight average diameter of 0.025 to 0.25 mm and are thermally stable, thermal cracking can be practiced at still improved efficiency. They found that absorption of liquid heavy oil by the porous material promotes the thermal cracking reaction or inhibits the formation of highly carbonaceous solids (hereinafter abbreviated as coke), and they called this "the capacitance effect" (see Japanese Laid-open Patent Publication No. 18783/1982).

Further, they have disclosed that in a similar process, comprising the step of thermal cracking of a heavy oil and the step of removing by gasification the coke deposited on the fine particles of a porous material, withdrawn from the thermal cracking step, wherein the gasification is accomplished by cotacting the fine particles with an oxygen-containing gas while the fine particles are circulated between the both steps, an effective embodiment has been shown, in which the fluidized-beds formed in the both steps are arranged adjacent to both sides of a thermally conductive partition wall (see Japanese Laid-open Patent Publication No. 158291/1982).

SUMMARY OF THE INVENTION

The present invention is concerned with an improvement of the prior invention by some of the present inventors.

More specifically, the process for thermal cracking of a heavy oil according to the present invention is a process, comprising a thermal cracking step of thermally cracking a heavy oil by contacting a heavy oil with fine particles of a porous material fluidized by a steam-containing gas to obtain primarily a light oil and a gasification step comprising gasifying the coke deposited on the fine particles by fluidizing the fine particles from the cracking step with a gas containing molecular oxygen and steam to be removed as the product gas, said steps being practiced while the fine particles are circulated between the both steps, which comprises carrying out these steps under the conditions as shown below:

(A) said fine particles are fine particles of a porous material constituted of fine spherical particles having a pore volume of 0.2 to 1.4 $cm^3/g$, a specific surface area of 10 to 1000 $m^2/g$, an average pore diameter of 10 to 5,000 Å and a weight average particle diameter of 0.03 to 0.15 mm, these properties being stable at the temperature employed;

(B) said product gas has a composition satisfying the following relationships in terms of volume ratio:

$$CO/CO_2 > 3/2$$

$$H_2/H_2O > 1$$

$$(CO+H_2)/\text{dry gas} > \tfrac{2}{3};$$

and (C) the gasification step is carried out under the following conditions:

(a) the coke deposited on the fluidized fine particles is at least about 5% by weight of said fine particles;

(b) the temperature of said fluidized fine particles is at least 750° C.;

(c) the apparent contact time of the gas is at least about 5 seconds; and (d) the nitrogen content in the molecular oxygen-containing gas is not higher than 20 vol. %.

In the present invention, by use of fine particles of a porous material and by forming a gas with a specific strongly reducing composition, a number of advantages can be obtained. Primary advantages are enumerated below:

(a) since the content of the components $(CO+H_2)$ is high, the product gas gives a high quantity of heat generation (about 2,000 $kcal/Nm^2$) and it is useful as a fuel;

(b) for the same reason as mentioned above, the product gas is useful as the starting gas for synthesis;

(c) since the gasification step is conducted under a strongly reducing atmosphere, the heavy metals (compounds of Ni, V and Fe) can readily be reduced, whereby precipitation of coke or generation of hydrogen caused by the heavy metals can be suppressed.

BRIEF DESCRIPTION OF THE DRAWING

The FIGURE is a flow chart showing an embodiment of the present invention, in which 1 is a thermal cracking reactor and 2 is a gasifying reactor.

DETAILED DESCRIPTION OF THE INVENTION

Basic Process

The basic process in the present invention is constructed of the thermal cracking step in which a heavy oil is contacted with a fluidized bed of porous fine powdery solid particles and the gasification step in which the fine powdery particles withdrawn from the cracking step are contacted with a gas containing molecular oxygen and steam to remove the coke deposited on the fine powdery particles, both steps being carried out while the fine powdery particles are circulated therebetween, and at the same time the gasification step being carried out so as to form a gas with a strongly reducing composition enriched in CO and $H_2$.

DIFFERENCE FROM THE PRIOR INVENTIONS

The present invention employs the same fine particles of a porous material as in the prior invention by some of the present inventors as mentioned above, but differ therefrom in the mode of practice. The present invention also differs from the FCC process in that the latter is a catalytic cracking with the use of a catalyst and also in the mode of practice. Further, the present invention differs from an example of the Flexicoking process in that the latter employs cokes with relatively coarse particles as the circulating particles as well as in the mode of practice and the object.

More specifically, in the present invention, fine particles of a porous material are employed similarly as in the prior invention by some of the present inventors. The fine particles are required to be fine particles of a porous material constituted of fine spherical particles having a pore volume of 0.2 to 1.4 $cm^3/g$, a specific surface area of 10 to 1000 $m^2/g$, an average pore diameter of 10 to 5,000 Å and a weight average particle diameter of 0.03 to 0.15 mm, and these properties are also required to be stable at the temperature employed. The values of these properties are slightly limited in the ranges as compared with those specified in said prior invention, and they have been determined for practicing effectively the present invention.

In the present invention, a gas with a strongly reducing composition is formed in the gasification step. In the prior invention by some of the present inventors as mentioned above, gasification of the coke deposited on the fine powdery particles is practiced, but no consideration has been paid as to the composition of the gas formed, and nothing is mentioned about formation of a gas with a strongly reducing composition. By gasification with ordinary air, only a gas with high content of nitrogen and thus low amount of heat generation can be obtained and no strongly reducing gas can be obtained.

FEEDSTOCK HEAVY OIL

The "heavy oil" as mentioned in the present invention means a hydrocarbon, which is usually a mixture, having a CCR value of 3 or higher, and include those which are solid at room temperature.

The feedstock heavy oil which can enjoy well the effect of the present invention is one having a relatively large amount of CCR, for example, about 5 or higher, preferably about 10 or higher. Examples of heavy oils suitable as feedstocks are heavy crude oil, a residue obtained by atmospheric distillation of a crude oil (hereinafter referred to merely as atmospheric residue), a residue similarly obtained by vacuum distillation of a crude oil (hereinafter called merely as vacuum residue), deasphalted oil, kerogen shale oil, tar sand oil, liquefied coal oil and the like.

FINE PARTICLES

The fine particles to be used in the present invention are as defined above.

That is, the fine particles to be used in the present invention have a pore volume of 0.2 to 1.4 $cm^3/g$, preferably 0.2 to 0.8 $cm^3/g$. The pore volume is important in that the particles have a sufficient volume effect. If it is less than (0.2 $cm^3/g$, the volume effect is insufficient, while a pore volume in excess of 1.4 $cm^3/g$, although its volume may be sufficient, is not practical because the particles tend to be fragile. The specific surface area of the fine particles, in correspondence to the average pore diameter, is appropriately 10 to 1,000 $m^2/g$ preferably 20 to 500 $m^2/g$. The average pore diameter of the fine particles is 10 to 5,000 Å, preferably 20 to 2,000 Å. If it is smaller than 10 Å, plugging with the coke deposited thereon will readily occur. On the contrary, with markedly large pores exceeding 5,000 Å, attracting force on the heavy oil toward innerside of the pores through capillary pressure will become insufficient and also the particles will become undesirably fragile.

Further, the fine particles to be used in the present invention is substantially spherical, with a weight average diameter being 0.03 to 0.15 mm, preferably 0.04 to 0.1 mm. Besides, the fine particles to be used in the present invention are required to maintain these properties even at the temperature employed.

A fluidized-bed formed of such fine particles is the so called "fluid bed" or fine powdery fluidized-bed and has smaller bubbles generated within the fluidized-bed, as compared with the so called "teeter bed" or coarse particle fluidized-bed consisting of greater particles, and also has smaller pressure fluctuation, thus exhibiting very uniform fluidized state. In such a uniform fluidized state, transfer of heat or materials can be promoted during thermal cracking and gasification reaction, and operations are very easy, with the result that abrasion of particles and equipment become small.

Examples of the fine particles suitable for the present invention include those of the materials conventionally used as carriers for fluidized-bed catalyst of the alumina type and the silica type, deteriorated catalyst of the silica-alumina type used in the FCC method, similarly the deteriorated catalyst of the aluminosilicate zeolite type, spherical activated charcoal and mixtures thereof. However, these are not limitative of fine particles in the present invention, but other materials can be used insofar as they have the properties as specified above. Besides, it is not required at all that the fine particles should have a catalytic activity on the cracking reaction of a heavy oil.

Among these, particularly preferred is a material conventionally used as a carrier for fluidized-bed catalyst of the alumina type. This is excellent in heat resistance and the changes in the particle properties during usage are very little.

The "pore volume" of the fine powdery particles as mentioned in the present invention refers to the total volume of the pores contained in the porous material of a unit weight, and it can be determined usually by boiling a porous material in a liquid, taking out the material and dividing the weight gain as measured when its surface has been just dried by the specific gravity of the liquid.

THERMAL CRACKING STEP

The reactor for thermal cracking is a vertical vessel for housing a fluidized-bed of fine particles, usually a longitudinal cylinder. At the bottom end of the reactor is an inlet for feeding a steam-containing gas, at the middle portion an inlet for feeding a feedstock oil and at the upper end a discharging outlet for the thermally cracked products via recovery equipments for scattered particles such as a cyclone and a dip-leg. The reactor is also provided with an inlet primarily for the particles circulated from the gasification step and an outlet primarily for the particles circulated to the gasification step. The reactor may also be equipped conveniently with inserts such as heat exchangers or perforated plates.

The temperature of the fluidized-bed for carrying out thermal cracking may be suitably about 350° to 600° C. The preferable temperature range is from 400° to 550° C. and the yield of the oil produced is at its maximum within this temperature range. It is preferred to pre-heat the feedstock oil or a steam-containing gas before feeding it into the reactor. The "steam-containing gas" to be introduced in order to carry out thermal cracking, while maintaining a fluidized state, may be pure steam or otherwise a mixture of pure steam with carbon dioxide, carbon monoxide, hydrogen, hydrocarbon, nitrogen and a mixture thereof. The amount of steam fed may be 1 to 100% by weight, preferably 5 to 50% by weight, as pure steam based on the heavy oil fed. At a level lower than the lower limit, the yield of the product oil will be lowered, while a level higher than the upper limit is not economical.

In the present invention, the amount of the fine particles circulated between the gasification step and the thermal cracking step can be markedly lowered, as compared with a conventional system, because the coke deposited on the finc particles can remain within the pores therein, whereby good fluidized state can be maintained even when the amount of the coke deposited may be increased. Thus, its lower limit depends only on the heat balance between the both steps. In the present invention, the amount of the particles circulated is generally 1- to 6-fold weight of the feedstock heavy oil fed, but it can be made further smaller, if additional heating of the thermal cracking is considered.

The ascending speed of the gaseous components in the fluidized-bed is ordinarily 5 to 160 cm/sec. in terms of superficial velocity of a column, preferably about 10 to 80 cm/sec., for obtaining the optimum fluidized state. The pressure is not particularly limited, but generally from atmospheric pressure to about 10 kg/cm$^2$.

PRODUCTS OF THE THERMAL CRACKING

The product oils obtained from the thermal cracking step of the present invention are liquid at room temperature comprising, for example, the naphtha fraction (b.p. lower than 170° C.), kerosene fraction (b.p. 170°-340° C.), light oil fraction (b.p. 340°-540° C.) and heavy oil fraction (b.p. higher than 540° C.) The product oil has smaller amount of the naphtha fraction as different from the catalytic cracking of the prior art and rich in the intermediate fractions such as kerosene fraction and the light oil fraction, because the process of the present invention is based on the thermal cracking reaction. Also, the content of the heavy oil fraction is very small. Other than such liquid oils at room temperature, a small amount of cracked gas capable of calorific value (gross) of about 5,000-10,000 kcal/Nm$^3$ is generated.

GASIFICATION STEP

Gasification of the coke deposited on the fine particles employed in the thermal cracking step, or in other words, regeneration of the used fine particles comprises contacting the used fine particles with a gas containing molecular oxygen and steam. The primary object of this step is to remove the deposited coke within the pores in the fine particles by gasification. Also, another object is to supplement heat to the thermal cracking step by the heated fine particles as a heat carrier.

The present invention is characterized, among others, in that it is practiced so as to obtain a strongly reducing product gas having a composition satisfying the three conditions in a volume ratio of:

$$CO/CO_2 > 3/2$$

$$H_2/H_2O > 1$$

$$(CO+H_2)/\text{dry gas} > \tfrac{2}{3}(\text{preferably} > \tfrac{3}{4})$$

The term "dry gas" means the product gas (of the gasification) from which only water is removed.

The reactor for gasification is a vertical vessel housing a fluidized-bed of fine particles, usually a longitudinal cylindrical column. At the lower end of the reactor of the gasification section is equipped an inlet for feeding a gas containing molecular oxygen and steam, at the upper end an outlet for discharging the product gas through a cyclone, dip-leg, etc., and inlets for introducing particles circulated from the thermal cracking step and discharging outlets to the thermal cracking step. The reactor may also be provided internally with inserts such as heat exchangers or perforated plates, as desired.

In practicing the present invention, in order to obtain a strongly reducing product gas as described above, the gasification reaction is required to proceed sufficiently.

The gasification will proceed through the oxidation reaction with oxygen and the reduction reaction with coke as shown below:

| | | |
|---|---|---|
| Oxidation reaction: | $C + O_2 = CO_2$ | (1) |
| Reduction reaction: | $C + CO_2 = 2CO$ | (2) |
| | $C + H_2O = CO + H_2$ | |

The reaction of the scheme (1) is generally called as combustion and its reaction rate is very rapid, but the reaction of the scheme (2) is very slow.

Accordingly, in order to obtain a product gas with high contents of CO and $H_2$, it is required to promote sufficiently the reduction reaction of the scheme (2).

For promoting the reduction reaction, first it is desirable that the coke concentration deposited on the fine particles is increased as clearly be seen from the scheme (2 ). For sufficient progress of the reduction reaction, it is preferable that the amount of the coke deposited is at least 5% by weight, particularly preferably about 7 to about 20% by weight, based on the fine particles.

In the present invention, a heavy oil with a high content of CCR is preferably used as the feedstock, which in turn is advantageous in that the quantity the coke deposited will be high. High quantity of coke deposited on the fine particles will not cause a trouble such as bogging which will otherwise tend to occur and which may cause instabilization of fluidization, because the coke is trapped in the pores. Deposition of coke on the particles of the fluidized-bed causes no problem of lowering in cracking yield which will occur to catalytic cracking because the cracking in accordance with the present invention is thermal cracking.

For sufficient progress of the reduction reaction, the reaction should desirably be accelerated by elevating the temperature of the fluidized fine particles. For this purpose, the gasification temperature is required to be at least 750° C., particularly preferably 780 to 1,000° C.

Further, $CO_2$ formed by the combustion reaction and the steam fed are converted to CO and $H_2$ through contact with the coke deposited on the fine particles while ascending through the fluidized-bed. Therefore, the product gas must reside within the fluidized-bed for a time sufficient for progress of the reduction reaction. For this purpose, the apparent contact time of the product gas (namely the ratio of fluidized-bed height/gas superficial velocity in a column) is required to be at least 5 seconds, particularly preferably about 5 to about 30 seconds.

Also, in practicing the present invention, it is necessary to lower the content of inert gas components (e.g. nitrogen) in the product gas. For this purpose, the nitrogen content in the gas containing molecular oxygen for fluidization of the fine particles is required to be lower. In the prior art, as a general practice, only air has been fed as the fluidizing gas in the gasification (in other words, the regeneration step). In the present invention, a gas containing oxygen at a higher concentration or pure oxygen is used as the fluidizing gas and, in order to suppress the heat generation in the gasification, an appropriate amount of steam is used in combination therewith, thereby promoting the endothermic reaction.

As the gas containing molecular oxygen at a high concentration, there may be employed a gas containing not more than 20% by volume of nitrogen, particularly preferably not more than 10% by volume of nitrogen.

For the purpose of avoiding a local temperature elevation within the fluidized-bed, the volume ratio of steam/molecular oxygen within the fluidizing gas is required to be 0.8 or higher, particularly preferably within the range of from 1 to 5.

The fluidizing gas should preferably be preheated prior to being fed. The fluidizing gas can contain a small amount of hydrogen, carbon monoxide, carbon dioxide, nitrogen, hydrocarbon or a mixture thereof.

The ascending speed of the gaseous components in the fluidized-bed is ordinarily 5 to 160 cm/sec. in terms of superficial velocity in a column, preferably about 10 to 80 cm/sec., for obtaining the optimum fluidized state. The pressure is not particularly limited, but generally from atmospheric pressure to about 10 kg/cm$^2$.

The reaction in the fluidized-bed will differ markedly depending on the stated of fluidization. For example, if large bubbles are formed within the fluidized-bed, such bubbles will be blown through the fluidized-bed without sufficient contact with the particles under unreacted state. Accordingly, for sufficient progress of the reduction, it is required to have a good fluidized state, where no large bubble is formed but small bubbles are dispersed uniformly throughout the fluidized-bed.

The present invention employs a typical fine powdery fluidized-bed which exhibits a very uniform and good fluidized state, and therefore the reduction reaction can be permitted to proceed to an extent enough to obtain a strongly reducing gas.

In the present invention, most of the heavy metal components such as of Ni, V, Fe, etc. in the feedstock heavy oil are deposited on the fine particles, thereby lowering markedly the heavy metal content in the oil as a product of the thermal cracking. As a result, a oil with low heavy metal can be obtained, but at the same time accumulation of heavy metals occurs on the fine particles. Accumulation of such heavy metals on the fine particles will promote stringent thermal cracking reactions to give rise to an unfavorable tendency to increase the amounts of gas generation or coke deposition.

However, in the present invention, the deleterious effect by accumulation of heavy metals can be suppressed to the minimum. More specifically, carbon monoxide and hydrogen formed in the gasification step will promote reduction of the respective metal components according to the reaction schemes as shown below:

$$V_2O_4+CO \rightarrow V_2O_3+CO_2$$

$$V_2O_4+H_2 \rightarrow V_2O_3+H_2O$$

$$NiO+CO \rightarrow Ni+CO_2$$

$$NiO+H_2 \rightarrow Ni+H_2O$$

$$FeO+CO \rightarrow Fe+CO_2$$

$$FeO+H_2 \rightarrow Fe+H_2O$$

As clearly be seen from the respective schemes set forth above, the reduction reactions of the respective heavy metals can be promoted better as the respective volume ratios of $CO/CO_2$, $H_2/H_2O$ and $(CO+H_2)$/dry gas are greater. In the present invention, the reduction reactions of the respective heavy metals can proceed particularly well, since the gas generated in the gasification step has a composition of volume ratios of $CO/CO_2>3/2$, $H_2/H_2O>1$ and $(CO+H_2)$/dry gasI$>\frac{2}{3}$.

The heavy metals converted into the reduced states as shown by the foregoing schemes act on the thermal cracking reactions by far more mildly than in the case of oxidized state, with suppressed increase in amounts of gas generation or coke deposition due to excessive progress of thermal cracking reactions, whereby lowering in yield of the cracked oil can be suppressed.

The sulfur compounds from the heavy oil attached on the fine particles are converted to hydrogen sulfide, a part of which reacts with the above heavy metal components to convert them into sulfides, thereby alleviating the deleterious effect by such heavy metal components.

According to a preferred embodiment of the present invention, the gasification step may be provided internally with a cooling means comprising cooling pipes through which water is to flow to generate steam. To control generation of the steam is, in turn to control the temperature control of the thermal cracking process with ease. There can thus be obtained an additional advantage that the temperature control of the thermal cracking process can be practiced only by control of the amount of the steam generated without altering other conditions. Moreover, the steam generated can also be used as at least a part of the fluidizing gas in the gasifying step and/or the thermal cracking step.

The steam can be generated at good efficiency by means of a cooling means comprising a vertical, horizontal or coil-like pipes through which water is to flow arranged appropriately in the zone of the fluidized-bed of the fine particle or immediately thereover. The system for generation of steam employed may be a system conventionally practiced in fluidized-bed boilers in general.

FLOW SHEET

The FIGURE is an example of the flow sheet for practicing thermal cracking according to the present invention.

In the FIGURE, 1 is a thermal cracking reactor for thermal cracking of a heavy oil, 2 is a gasification reactor for removal of the coke deposited on the fine particles during thermal cracking by gasification, and 3 is a cooler for separating the product formed by cracking into the product oil and the cracked gas.

Into the thermal cracking reactor 1 is fed from the bottom portion thereof steam or a steam-containing gas through the conduit 4, and heavy oil as a feedstock is fed alone or together with steam from the conduit 5. The fine particles filled in the thermal cracking reactor is fluidized by the feed of the above materials, and thermal cracking reaction proceeds primarily at the position upper than the position where the feedstock heavy oil is fed, while the product oil entrapped within the pores of the fine particles is subjected to stripping at the position lower than said position, while descending in a fluidized state through the perforated plate 6.

The products of the thermal cracking are removed of the accompanying fine particles by means of a cyclone 7 and a dip-leg 8 provided at the column top and, passing through the conduit 9, reaches a cooler.

The condensed liquid product, namely the product oil, is separated in a reservoir 10 and the uncondensed gas, namely the cracked gas, is removed out of the system via the conduit 11.

The fine particles having coke deposited thereon as the result of thermal cracking is discharged from a conduit 15 at the bottom and delivered by an ejector 14 with a gas such as nitrogen or steam from a conduit 14, by passing through a conduit 16, via a cyclone 16 and a dip-leg 17, to the gasification reactor, and the gas such as nitrogen or steam is discharged out of the system through a conduit 18.

Steam or a steam-containing gas from a conduit 19 and a molecular oxygen-containing gas from a conduit 20, namely the gas containing oxygen at a high concentration, are mixed and fed via a conduit 21 to the bottom of the gasification reactor. The fine particles having coke deposited thereon delivered from the thermal cracking reactor and filled in the gasification reactor is fluidized with the gas fed from a conduit 21 and a part of the coke is gasified. The product gas is removed of the accompanying fine particles by a cyclone 22 and a dip-leg 23 provided at the top of the gasification reactor and taken out of the system through a conduit 24. The fine particles subjected to the gasification reaction are circulated through an overflow pipe 25 to the thermal cracking reactor.

Also, if desired, water is introduced from a conduit 26 into a heat transfer pipe 27, wherein it is converted to steam and taken out from a conduit 28. This steam is discharged out of the system through a conduit 29, or via a conduit 30, passing through a conduit 31 and/or a conduit 32, enters a conduit 19 and/or a conduit 4 and is then led to the gasification reactor and/or the thermal cracking reactor.

EXPERIMENTAL EXAMPLES

EXAMPLE 1

(1) Experimental device:

The same device as shown in the FIGURE was employed. The thermal cracking reactor was cylindrically shaped with an inner diameter of 5.4 cm and a height of the fluidized-bed portion of 1.8 m, with an inlet pipe for feeding the feedstock oil being positioned at 0.6 m from the lower end, and 1.2 m upper than the inlet was primarily the thermal cracking reaction zone and about 0.6 m lower than the inlet was the stripping zone. In the stripping zone, 5 sheets of porous plates with a percentage perforation area relative to the horizontal cross-sectional area of the fluidized-bed of 20% were arranged at intervals of 0.1 m. The gasification reactor had an inner diameter of 8.1 cm and a height of the fluidized-bed portion of about 1.5 m, and no heat transfer pipe for generation steam was provided. All the devices employed were made of stainless steel.

(2) Experimental conditions:

As the fluidized particles, 3.3 kg of fine particles of a porous material of the alumina type for use as a carrier of a fluidized-bed catalyst were filled and about 1.8 kg/hour were circulated between the both reactors. From the inlet pipe at the bottom of the thermal cracking reactor, 100 g/hour of steam pre-heated to 400° C. was fed from the inlet pipe, and 100 g/hour of steam pre-heated to about 400° C. was fed together with 585 g/hour of a heavy oil pre-heated to 300° C. from the inlet for feedstock oil. The fine particles on which coke had precipitated was continuously discharged from the thermal cracking reactor and transported with nitrogen to the gasification reactor.

From the inlet pipe at the bottom of the gasification reactor, 130 g/hour of steam heated to about 400° C. and 130 N liters/hour of oxygen of room temperature were fed, the volume ratio of steam/oxygen being 1.24.

The temperature of the fluidized-bed in the thermal cracking reactor was adjusted to be at 450° C., the temperature of the fluidized-bed in the gasification reactor at 820° C., respectively. The pressure employed was 0.5 kg/cm$^2$-G The superficial velocity in a column was about 10 Ncm$^3$/sec., and the apparent contact time about 15 sec.

The products of the thermal cracking were cooled with water and brine to room temperature and the product oil was condensed together with water, and the gas produced was separated.

The feedstock heavy oil was a vacuum residue, having the following properties:

Specific gravity=1.026, Heavy oil fraction (b.p. of 540° C. or higher)=93 wt. %, CCR=21.9 wt. %, sulfur=5.9 wt. %.

The fine particles employed had the following properties:

Bulk density=0.39 g/cm$^3$, Pore volume=1.36 cm$^3$/g, Specific surface area=320 m$^2$/g, Average pore diameter=260 Å, Weight average diameter=0.068 mm.

(3) Experimental results:

| | |
|---|---|
| Yield of product oil | 398 g/hour |
| (Percent yield based on feedstock heavy oil) | 68.0 wt. % |
| Composition of the product oil: | |
| Naphtha fraction (b.p. lower than 170° C.) | 12 wt. % |
| Kerosene fraction (b.p. 170–340° C.) | 31 wt. % |
| Light oil fraction (b.p. 340–540° C.) | 51 wt. % |
| Heavy oil fraction (b.p. higher than 540° C.) | 6 wt. % |
| Total | 100 wt. % |
| Yield of the cracked gas | 2.9 N liter/hour |
| Composition: | |
| $H_2$ | 43 vol. % |
| $CH_4$ | 16 vol. % |
| $C_2H_6$, $C_2H_4$ | 12 vol. % |
| $C_3H_8$, $C_3H_6$ | 9 vol. % |
| $C_4^+$ | 10 vol. % |
| $H_2S$, $CO_2$, CO, $N_2$ | 10 vol. % |
| Total | 100 vol. % |
| Product gas (dry) | 380 N liter/hour |
| Composition: | |
| $CO_2$ | 22 vol. % |

-continued

| | |
|---|---|
| CO | 48 vol. % |
| $H_2$ | 27 vol. % |
| $H_2S$ | 2 vol. % |
| $N_2$ | 1 vol. % |
| Total | 100 vol. % |

$CO/CO_2 = 2.2$
$(CO + H_2)$/total dry gas = 0.75
$H_2/H_2O$ volume ratio in wet gas = 1.8
Total amount of calorific value (gross) after removal of $H_2S$: 2,290 Kcal/$Nm^3$ When a part of the circulated particles was sampled and measured for the carbon in the deposited materials in a conventional manner, the following values were obtained.

| | |
|---|---|
| Particles within the thermal cracking reactor | 15 wt. % |
| Particles within the gasification reactor | 8 wt. % |

Example 2

For examination of the effect of heavy metals on thermal cracking, for fluidized particles, fine particles of a porous material of the alumina type for use as a carrier for a fluidized-catalyst impregnated with 1.7% of Ni was used. The experimental device employed was the same as in Example 1 and the experiment was conducted under the same conditions except for the amount of steam and oxygen fed into the gasification reactor.

For comparison, the experiment for obtaining a product gas having a conventional composition was also conducted.

The results are as shown below.

| | Invention | Control |
|---|---|---|
| Gasification conditions | | |
| Amount of oxygen fed (N liter/hour) | 140 | 250 |
| Amount of air fed (N liter/hour) | — | 60 |
| Amount of steam fed (g/hour) | 120 | 60 |
| Composition of product gas (dry)* (vol. %) | | |
| $CO_2$ | 26 | 43 |
| CO | 49 | 41 |
| $H_2$ | 25 | 4 |
| $N_2$ | 0 | 11 |
| Volume ratio of $H_2/H_2O$ in wet gas | 1.87 | 0.35 |
| Results of thermal cracking | | |
| Yield of product oil (wt. %) | 65.4 | 59.2 |
| Yield of cracked gas | 8.0 | 8.7 |
| $H_2/CH_4$ molar ratio in cracked gas | 3.9 | 6.7 |

*Value after removal of $H_2S$ in product gas.

As can be seen from these results, in the present invention, by reduction of heavy metals with a strongly reducing gas formed in the gasification reaction step, excessive thermal cracking with heavy metals can be suppressed, whereby the yield of the product oil is higher and the amount of the cracked gas is lower, and yet the percentage of hydrogen formed is low.

What is claimed as new and desired to be secured by Letters Patent of the United States is:

1. A process for thermally cracking a heavy hydrocarbon oil and recycling into the fluidized bed of a thermal cracking reactor, porous fine particles substantially free of coke deposits, said process comprising:

(A) thermally cracking in a reactor a heavy hydrocarbon oil in contact with a fluidized bed of heated solid porous particles in the presence of steam, said heated solid particles having fine spherical particles having a pore volume of 0.2 to 1.4 $cm^3/g$, a specific surface area of 10 to 1000 $m_2/g$, an average pore diameter of 10 to 5000 Å and a weight average particle diameter of 0.03 to 0.15 mm, thereby primarily obtaining a product light oil;

(B) withdrawing from said reactor said solid porous particles having at least 5% by weight of coke (C) gasifying in a gasification chamber said coke by fluidizing said solid porous particles withdrawn from step (B) with a gas containing molecular oxygen and steam and no more than 20 vol. % nitrogen, wherein the temperature in the gasification chamber is at least 750° C. and wherein the apparent contact time of the product gas of this step with the porous particles in said chamber is at least 5 seconds;

(D) discharging from said gasification chamber a product gas having a volume ratio of $CO/CO_2$ greater than 3/2 $H_2/H_2O$ greater than 1, and $(CO_2+H_2)$/dried gas greater than $\frac{2}{3}$; and (E) circulating said fluidized solid porous particles of step (C) from the gasification chamber to said thermal cracking reactor.

2. The process according to claim 1, wherein the gasification in step (C) is carried out under the following conditions:

(e) the coke deposited on the fluidized fine particles is at least about 7 to about 20 by weight of said fine particles;

(f) the temperature of said fluidized fine particles is 780 to 1,000° C.;

(g) the apparent contact time of said product gas is about 5 seconds to about 30 seconds; and (h) the nitrogen content in the molecular oxygen-containing gas is not greater than 10 vol. %.

3. The process according to claim 1, wherein the volume ratio of steam to molecular oxygen in the gas containing molecular oxygen and steam for fluidizing the fine particles in the gasification is at least 0.8.

4. The process according to claim 3, wherein the volume ratio of steam to molecular oxygen in the gas containing molecular oxygen and steam for fluidizing the fine particles in the gasification is 1 to 5.

5. The process according to claim 1, wherein steam is generated in a cooling means provided in the gasification where the coolant is water to generate the steam.

6. The process according to claim 1, wherein said fine spherical particles, which constitute the particles of the fluidized bed of step (A), have a pore volume of 0.2 to 0.8 $cm^3/g$, a specific surface area of 20 to 500 $m^2/g$, an average pore diameter of 20 to 2000 Å and a weight average particle diameter of 0.04 to 0.1 mm.

7. The process according to claim 1, wherein the ascending speed of the gaseous components in the fluidized-bed in step (C) is 5 to 120 cm/second.

8. The process according to claim 12, wherein said ascending speed ranges from 10 to 80 cm/second.

9. The process according to claim 1, wherein the solid porous particles withdrawn from the reactor of step (A) have heavy metals as metal compounds deposited thereon.

10. The process according to claim 9, wherein said heavy metals are nickel, vanadium and iron.

11. The process according to claim 9, wherein during the gasification treatment of step (C) said product gas reduces the heavy metal compounds to reduced valence states of the metals.

* * * * *